United States Patent [19]

Howard

[11] Patent Number: 5,044,015

[45] Date of Patent: Sep. 3, 1991

[54] GOLF JACKET WITH HAND COVER

[76] Inventor: Gary Howard, 106 Leonard St., Canton, Mass. 02021

[21] Appl. No.: 610,133

[22] Filed: Nov. 5, 1990

[51] Int. Cl.[5] ..... A41D 27/10

[52] U.S. Cl. ..... 2/269; 2/16; 2/59; 2/125; 2/108

[58] Field of Search ..... 2/269, 16, 108, 59, 2/158, 125, 85, 159

[56] References Cited

U.S. PATENT DOCUMENTS 3,203,005 8/1965 Burrows ..... 2/158
4,543,670 10/1985 Ehring ..... 2/85
4,631,753 12/1986 Ehring ..... 2/269
4,944,042 7/1990 Dewan ..... 2/85

*Primary Examiner*—Werner H. Schroeder
*Assistant Examiner*—Gloria Hale
*Attorney, Agent, or Firm*—William Nitkin

[57] ABSTRACT

A protective structure for keeping a golfer's hands and golf club grip dry in the rain combining a golf jacket and an extension member extending from one of said jacket's sleeves over the golfer's hand and club with a slit defined in the side of the extension member through which the golfer can insert his other hand to grasp the club grip.

3 Claims, 2 Drawing Sheets

GOLF JACKET WITH HAND COVER

BACKGROUND OF THE INVENTION

1. Field of the Invention

The structure of this invention resides in the area of golf jackets and more particularly relates to a golf jacket with an extension to be worn in the rain to protect the golfer's hands and club grip which rain might otherwise cause the club to slip within the golfer's grasp.

2. Description of the Prior Art

It has long been appreciated by golfers that one must maintain a non-slippery grasp of the golf club. When it rains, the grip will invariably get wet making it very difficult to maintain an adequate grasp. A wet grip of the club will usually cause an unsatisfactory striking of the ball. In the prior art, gloves to be worn in the rain have been created to protect the user's hands. One such example is U.S. Pat. No. 3,203,005 to Burrows which discloses a two-handed mitten having two openings for the insertion therein respectively of the golfer's hands and an opening for the insertion of the club's grip for grasping. Another approach to this problem is seen in the dry-grip sleeve disclosed in U.S. Pat. No. 3,397,891 to T. Koch wherein an enclosure of a cloth material is provided into which one or both hands can be inserted through the same opening with the club's grip inserted into another opening below and which sleeve can, in one embodiment, have a stretchable top for the accommodation of both hands therein if desired. A more recent patent, U.S. Pat. No. 4,564,956 to DiBuono for a Golf Glove with Rain Shield shows a covering structure with two openings for the hands and one for the golf club grip to be inserted therein. A golf glove is incorporated within the structure into which one hand is inserted while the other hand passes through a slit in the body of the structure to also grasp the club grip.

A common problem with the prior art is that these structures represent extra accessories which must be purchased separately and carried with the golfer. These accessory items can frequently become lost or misplaced and can be difficult to find in one's golfbag as they are frequently made of fabric and will wrinkle when thrown into a bag with other golfing paraphernalia. These golf accessories also can get wet during the process of putting them on. One may also have to remove their regular golf glove to utilize some of these prior art golf accessories. Furthermore, some of these glove structures are restrictive to the hand and arm movements which would interfere with the golfer's swing.

SUMMARY OF THE INVENTION

It is an object of this invention to provide a convenient-to-use golf jacket with means to allow a golfer to maintain a dry grasp of a golf club in rainy weather.

It is a further object of this invention to provide an improved rain protective structure to overcome the problems associated with having separate glove and hand covering accessories for the maintenance of dry hands and golf club grip when swinging a golf club in the rain.

in order to accomplish the objects of this invention, an extension structure is built into the appropriate sleeve of a water-resistant golf jacket, the appropriate sleeve depending upon whether the golfer is right or left-handed. This invention utilizes such extension at the end of a golf jacket sleeve wherein the extension can to be tucked up into the golf jacket sleeve when not in use. When the extension is disposed inside the golf jacket sleeve, the extension does not add any significant weight or cause any impediment to the normal use of the golf jacket when swinging the golf club. When the golfer desires to use this invention, the golfer pulls the extension out from the sleeve and draws it down over and beyond his hand. A slit is provided in the side of the extension for insertion of the golfer's other hand therethrough, and the golf club is inserted into the open end of the extension so that the golfer's hands are covered within the extension structure. When not in use, the extension can be tucked back up into the golf jacket sleeve. The golf jacket with the extension of this invention provides protection for the hands and golf club grip to prevent them from getting wet in the rain. Also, the golf jacket with the extension of this invention can be lined to provide insulation to keep the golfer's hands warm in cold weather.

DESCRIPTION OF THE PREFERRED EMBODIMENT(S)

Figure 1:
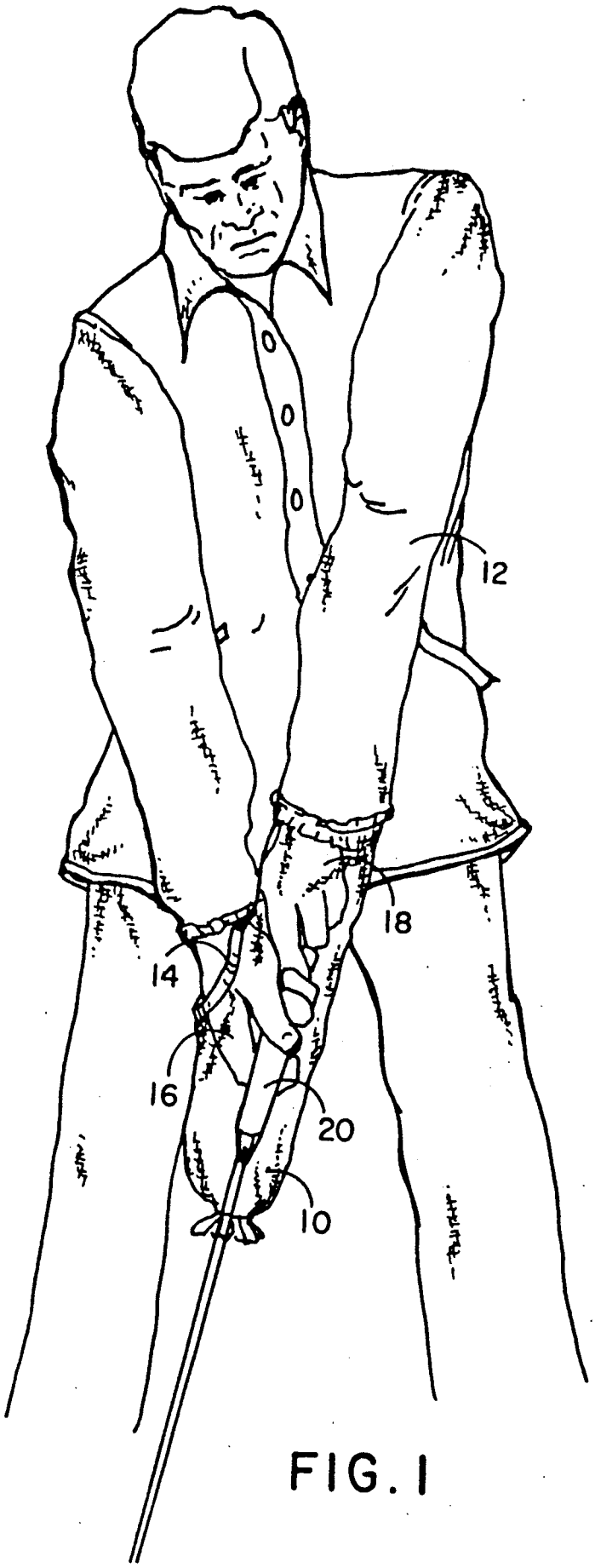
FIG. 1 illustrates a perspective view of a golfer utilizing the golf jacket with extension of this invention.
Figure 2:
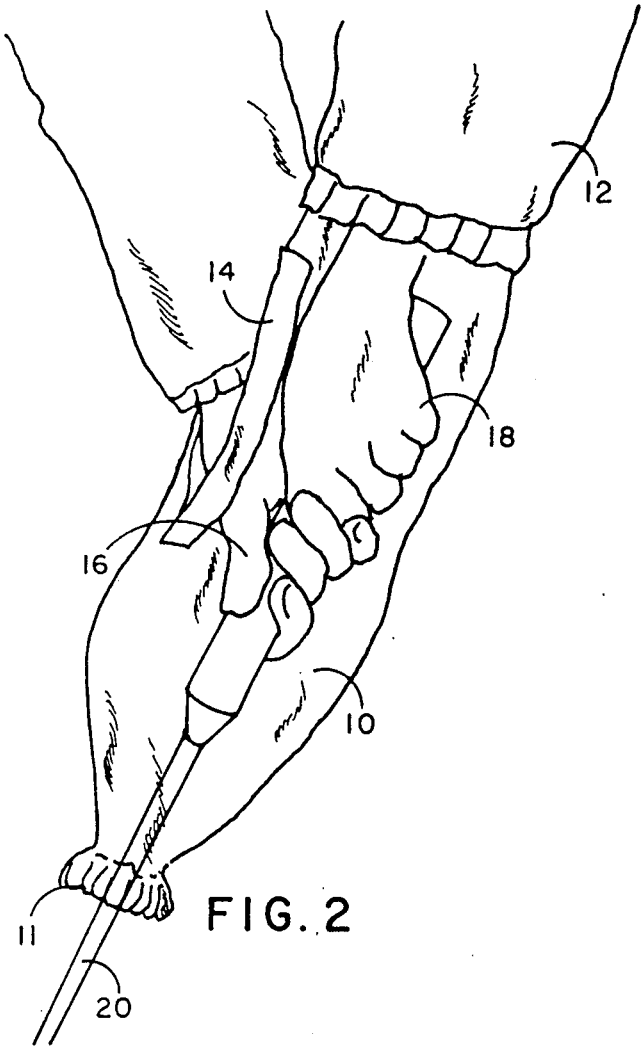
FIG. 2 illustrates a perspective view of the hands and arms of a golfer utilizing this invention with a golfclub inserted therein.
Figure 3:
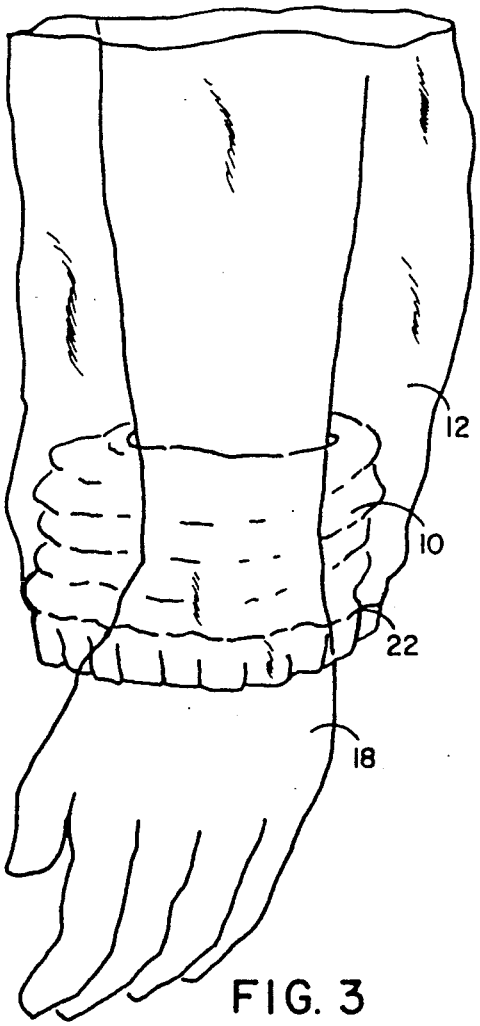
FIG. 3 illustrates the extension member tucked up into the sleeve of the golf jacket.

FIG. 1 illustrates a golfer wearing the golf jacket with extension 10 of this invention which, when not in use, is tucked up within sleeve 12 as seen in FIG. 3. Extension 10, as seen in FIG. 2, is attached to sleeve 12 of the jacket along seam 22, and the golfer's hand 18 extends out from the end of jacket sleeve 12 in the normal fashion. When the golfer desires to use the structure of this invention, he pulls out extension 10 from golf jacket sleeve 12. The extension hangs down over hand 18, and golf club grip 20 is then passed into open end 11 of extension 10. Slit 14 is provided in the side of the extension facing the other arm of the golfer. Slit 14 allows the golfer's other hand 16 to be inserted therethrough to grasp the club's grip 20. The golfer can then proceed to play golf with a dry grasp of the grip contained within extension 10 and swing the golf club in the normal manner whether driving, chipping, putting or the like. As mentioned above, the extension can also be lined to keep the golfer's hands warm. When the golfer no longer wishes to use the extension, he removes his hand from slot 14 and removes the club through open end 11 of extension 10. The golfer can then tuck extension 10 back up into golf jacket sleeve 12.

It should be noted that the extension can be positioned on either the left or right hand sleeve of the golf jacket with the slit for a left-handed golfer usually positioned vertically in the left side of the extension and the slit for a right-handed golfer positioned on the right side of the extension. The extension can be made of nylon material, for example, or any water-resistant material commonly used for lightweight golf jackets. When tucked back up into the golf jacket sleeve 12, extension 10 rests around the arm and wrist and does not interfere in any way with the normal use of the jacket. in this way one has no chance of losing or misplacing the rain protective feature of this invention as in the prior art's separate mittens and the like. One can extend extension 10 downward at any desired time over the hand and club grip and insert the other hand through the slit which is disposed in the side of the extension sleeve facing the opposite arm. The slit is close to the end of the golf jacket sleeve with open end 11 of extension 10 extending further down from the golf jacket sleeve end approximately a foot or more not only to cover the hands adequately but also to keep the club grip in a dry state.

Although the present invention has been described with reference to particular embodiments, it will be apparent to those skilled in the art that variations and modifications can be substituted therefor without departing from the principles and spirit of the invention.

I claim:

1. A protective structure for keeping a golfer's hands and golf club grip dry in the rain, comprising in combination:

a golf jacket having two sleeve members with open ends at the bottom of said sleeves through which open ends said golfer's hands and arms extend;

an extension member having an open top and an open bottom, said open top being attached to the inside of one of the open ends of said golf jacket sleeves, said extension member when not being used, being tucked up into said golf jacket sleeve with the golfer's arm being passed through both said sleeve and said extension member and when being used, said extension member is pulled out and extended downward to cover said golfer's hand, said extension member having said golf club grip inserted in said open bottom of said extension member; and a slit defined in said extension member disposed near the end of said golf jacket sleeve and facing toward said golfer's opposite arm, said slit of a size sufficient to receive the other hand of said golfer therethrough for grasping said golf club grip when said grip is inserted up into the open bottom end of said extension member to protect and keep said golfer's hands and golf club grip dry during use in the rain.

2. The structure of claim 1 wherein said extension member is made of a water-resistant material.

3. The structure of claim 1 further including a lining in said extension member for use when said extension member is used to keep the golfer's hands warm.

* * * * *